US010464705B2

(12) United States Patent
Mevada et al.

(10) Patent No.: US 10,464,705 B2
(45) Date of Patent: Nov. 5, 2019

(54) DISCARDING DEFECTIVE LABEL

(71) Applicants: Maheshkumar Jayantilal Mevada, Ahemdabad (IN); Nirav Jayantilal Mevada, Ahemdabad (IN)

(72) Inventors: Maheshkumar Jayantilal Mevada, Ahemdabad (IN); Nirav Jayantilal Mevada, Ahemdabad (IN)

( * ) Notice: Subject to any disclaimer, the term of this patent is extended or adjusted under 35 U.S.C. 154(b) by 0 days.

(21) Appl. No.: 15/545,637

(22) PCT Filed: Apr. 6, 2016

(86) PCT No.: PCT/IB2016/051943

§ 371 (c)(1),
(2) Date: Jul. 21, 2017

(87) PCT Pub. No.: WO2017/055936

PCT Pub. Date: Apr. 6, 2017

(65) Prior Publication Data

US 2018/0186496 A1 Jul. 5, 2018

(30) Foreign Application Priority Data

Sep. 28, 2015 (IN) ..... 3664/MUM/2015

(51) Int. Cl.

| | |
|---|---|
| ***B65C 9/40*** | (2006.01) |
| ***B65C 9/18*** | (2006.01) |
| ***B65C 9/00*** | (2006.01) |

(52) U.S. Cl.

CPC ..... *B65C 9/40* (2013.01); *B65C 9/1865* (2013.01); *B65C 2009/0093* (2013.01);
(Continued)

(58) Field of Classification Search

CPC .. B65C 1/00; B65C 1/021; B65C 9/08; B65C 9/36; B65C 9/40; B65C 9/42; B65C 9/46;
(Continued)

(56) References Cited

U.S. PATENT DOCUMENTS

2005/0274458 A1* 12/2005 Carver ..... B65C 9/0006 156/702
2007/0256788 A1* 11/2007 Ford ..... B65C 9/1884 156/358
2009/0242097 A1* 10/2009 Esposito ..... B65C 9/188 156/64

FOREIGN PATENT DOCUMENTS

EP 1072520 1/2001
WO 2008012633 1/2008

* cited by examiner

*Primary Examiner* — George R Koch
(74) *Attorney, Agent, or Firm* — Crose Law LLC; Bradley D. Crose

(57) ABSTRACT

In accordance with an aspect of the present invention, an apparatus to discard defective label form a labeling machine is provided. The invention includes a label path to move a label web containing a plurality of labels from an origin station to a destination station. The invention then includes an inspection unit to detect the defective labels from the plurality of labels in the label path. The invention also includes a defective label discarding unit configured to discard the defective labels from the label path. The invention further includes, a collecting unit to collect the plurality of defective labels. The invention then includes, a labeling unit configured to label the good label in a required product and a processor to synchronize the label path, the inspection unit, the defective label discarding unit, the collecting unit and the labeling unit.

10 Claims, 10 Drawing Sheets

(52) U.S. Cl.
CPC ..... *B65C 2009/404* (2013.01); *B65H 2301/51122* (2013.01); *B65H 2404/64* (2013.01)

(58) Field of Classification Search
CPC ..... B65C 2009/402; B65C 2009/404; B65C 2009/405; B65C 2009/407; B65C 2009/408; B65C 2009/0093
USPC ..... 156/360, 366, 367, 368, 538, 539, 156/DIG. 2, DIG. 3, DIG. 4, DIG. 27, 156/DIG. 42, DIG. 45, DIG. 47; 700/213
See application file for complete search history.

DISCARDING DEFECTIVE LABEL

This application is a 371 of PCT/IB2016/051943, filing date Apr. 6, 2016.

FIELD OF THE INVENTION

This invention relates, generally, to the field of labeling products and more particularly, to the field of discarding defective label.

BACKGROUND OF THE INVENTION

The packaging industry has gained utmost importance in the current industrial setup and has amply manifested itself in various domains such s FMCG, drugs and like consumables. The labeling of a product packaging has now become an integral part of packaging requirements. In such a situation it becomes very important to provide a packaging strategy which is economical, viable, easy to manufacture, and has appropriate labels, to be sold notwithstanding the nature and type or product/consumable.

Conventionally various packaging techniques use labels that has some defective image or text or color. The defective label in few products may lead to misguide consumers. One such example is warning in drug packaging. Hence, in such situation it becomes vital to check and provide appropriate labels. For some products, there is an obligatory requirement to provide proper labeling. Generally various packaging techniques uses check mechanism to provide proper labeling. One such class of techniques for providing proper labeling products is manually checking the product with labels and discarding products with defective labels. However, manually checking and discarding product with defective labels results in wastage of products with defective labels and there are chances to miss out products with defective labels. Moreover, in few cases, defective labels are not identified by human eye, for a non-limiting example, missing of a line in a bar code.

Another class of technique is providing a sensor to detect defective label and providing a suction mechanism to pluck defective labels from a label web in a labeling machine. However, such technique results in high usage of power and there are chances where labels with more adhesive remain on the web. Also there is an obligation requirement to track defective label for various reasons, one such example is to track number of product released in the market. In this class of technique there are chances to miss defective label in the process. Hence there is also a requirement to collect all defective labels and have a proper count on the defective labels.

On another class of technique is to remove defective labels from the product. However, removing defective labels from the product may lead to damage of the product and also results in high effort, time and money utilization in labeling industry.

Based on the classes of packaging techniques discussed above, it may be understood by a person skilled in the art that there is a need of providing a packaging strategy which does away with the eminent problem as discussed above. The instant invention aims at realizing the aforesaid disadvantages by offering a solution in accordance with the manner described.

SUMMARY OF THE INVENTION

An aspect of the present invention is to address at least the above-mentioned problems and/or disadvantages and to provide at least the advantages described below. Accordingly, an aspect of the present invention is an apparatus to discard defective label form a labeling machine.

In accordance with an aspect of the present invention, an apparatus to discard defective label form a labeling machine is provided. The invention includes a label path configured to move a label web containing a plurality of labels from an origin station to a destination station, the said label path further includes a label path in a label web to carry the plurality of labels from the origin station to the destination station. In an embodiment the plurality of labels includes a plurality of good labels, or a plurality of defective labels, or a combination thereof. The invention then includes an inspection unit configured to detect the defective labels from the plurality of labels in the label web, the said inspection unit further includes a defect detector unit configured to compare a current label on the label path with a pre-required configurations so as to identify the good labels or the defective labels. In a preferred embodiment the inspection unit sends a good label signal or a defective label signal or a combination thereof to a defective label discarding unit. The invention also includes the defective label discarding unit configured to discard the defective labels from the label web, the defective label discarding unit further includes a push mechanism, a movable plate and a static guide roller in the label path. In an embodiment the movable plate is configured inside the static guide roller, wherein, the push mechanism is configured either to positioned at an original position in case the push mechanism receives the good label signal so that the movable plate is placed inside the static guide roller or the push mechanism pushes the movable plate if the push mechanism receives the defective label signal from the inspection unit so that the movable plate comes out of the static guide roller to give an angular motion to the label path so as to give a mechanical pressure to the starting of the defective label on the label path in contact with the movable plate that results in peeling of an initial portion of the defective label. The invention further includes, a collecting unit configured to collect the plurality of defective labels, the collecting unit further includes a motorized roll winder configured to move in case of the defective label signal. In an embodiment, the motorized roll winder is positioned such that the initial portion of the defective label sticks in a roll of the motorized roll winder once it comes out of the label path so that full label is plucked out of the label path and sticks in the motorized roll winder. In a preferred embodiment, the motorized roll winder material is selected on the basis of sticking properties of self-adhesive labels in the label web. The invention then includes, a labeling unit configured to label the good label in a required product and a processor to synchronize the label path, the inspection unit, the defective label discarding unit, the collecting unit and the labeling unit.

In accordance with an aspect of the present invention, a process to discard defective label from a labeling machine is provided. The process includes moving a label web containing a plurality of labels in a label path configured to move from an origin station to a destination station in a labeling machine, the said label path further includes a label web to carry the plurality of labels from the origin station to the destination station. In an embodiment, the plurality of labels includes either of a plurality of good labels, or a plurality of defective labels, or a combination thereof. The process then includes, inspecting the plurality of labels in the label path to detect the defective labels from the plurality of labels in the label web, the said inspecting the plurality of labels further includes steps of detecting at least one of the defective labels or the good labels by a defect detector unit by comparing a current label on the label web with a pre-required configurations so as to identify the good labels or the defective labels and sending a signal corresponding to the current label to a defective label discarding unit. In a preferred embodiment, the said signal comprises at least one of a good label signal or a defective label signal or a combination thereof. The process also includes, discarding the defective label from the label web, discarding the defective label from the label web further comprises steps of pushing a movable plate placed in a static guide roller by a push mechanism out of the static guide roller after receiving the defective label signal. In an embodiment, the push mechanism is configured either to positioned at an original position in case the push mechanism receives the good label signal so that the movable plate is placed inside the static guide roller or the push mechanism pushes the movable plate if the push mechanism receives the defective label signal from the inspection unit so that the movable plate comes out of the static guide roller to give an angular motion to the label path so as to give a mechanical pressure to the starting of the defective label on the label path in contact with the movable plate that results in peeling of an initial portion of the defective label. The process further includes, collecting the plurality of defective labels by a collecting unit when the defective label signal is received, collecting the plurality of defective labels by a collecting unit further comprises steps of placing a motorized roll winder such that initial portion of the defective label peeled out by the moving plate sticks to a roll of the motorized roll winder so as to pluck full said defective label and stick in the motorized roll winder. In a preferred embodiment, the motorized roll winder material is selected on the basis of sticking properties of self-adhesive labels in the label web. The process also includes, labeling the good label in a required product after receiving the good label signal and synchronizing the steps of moving the label web, inspecting the plurality of labels, discarding the defective label from the label web, collecting the plurality of defective labels by the collecting unit and the labeling of the good label in the required product by a processor.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF FIGURES

The above and other aspects, features, and advantages of certain exemplary embodiments of the present invention will be more apparent from the following description taken in conjunction with the accompanying drawings, in which.

Persons skilled in the art will appreciate that elements in the figures are illustrated for simplicity and clarity and may have not been drawn to scale. For example, the dimensions of some of the elements in the figure may be exaggerated relative to other elements to help to improve understanding of various exemplary embodiments of the present disclosure.

Throughout the drawings, it should be noted that like reference numbers are used to depict the same or similar elements, features, and structures.

DETAILED DESCRIPTION

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

FIGS. 1, 2, 3, 4, 5, 6, 7, 8, 9 and 10, discussed below, and the various embodiments used to describe the principles of the present disclosure in this patent document are by way of illustration only and should not be construed in any way that would limit the scope of the disclosure. The terms used to describe various embodiments are exemplary. It should be understood that these are provided to merely aid the understanding of the description, and that their use and definitions in no way limit the scope of the invention. Terms first, second, and the like are used to differentiate between objects having the same terminology and are in no way intended to represent a chronological order, unless where explicitly stated otherwise.

Figure 1:
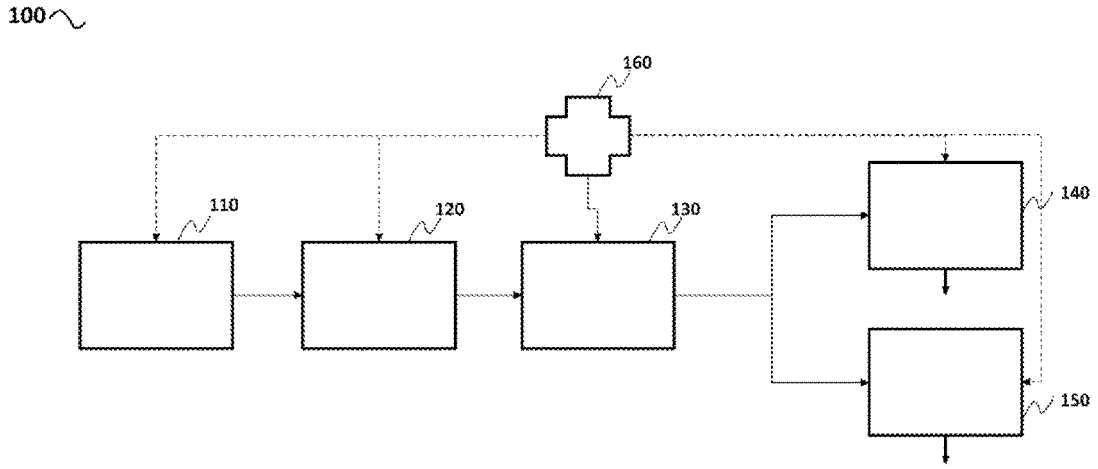
FIG. 1 illustrates an apparatus to discard defective label from a labeling machine, in accordance with an exemplary embodiment of the present invention.

FIG. 1 illustrates an apparatus to discard defective label from a labeling machine, in accordance with an exemplary embodiment of the present invention.

Referring to FIG. 1, an arrangement 100, illustrates an apparatus to discard defective label from a labeling machine.

In accordance with an aspect of the present invention, an arrangement 100 is provided for an apparatus to discard defective label from a labeling machine. A label path 110, is selected to move a label web including a plurality of labels from an origin station to a destination station. The said label path 110 further includes a label path to carry the plurality of labels from the origin station to the destination station. In an embodiment the plurality of labels includes either of a plurality of good labels, or a plurality of defective labels or a combination thereof. In a preferred embodiment, defective labels are those labels those do not match a predetermined parameters of good label, for a non-limiting example, a label with different color or missing a part or whole of a text, or a logo, or a vision, or a coding by various coding techniques or a barcode information is the defective label.

An inspection unit 120, is placed in the label path 110, to detect the defective labels from the plurality of labels in the label web, the said inspection unit 120, further includes a defect detector unit configured to compare a current label on the label web with a pre-required configurations so as to identify the plurality of good labels or the plurality of defective labels. In an embodiment, the said inspection unit 120 sends a good label signal or a defective label signal to a defective label discarding unit 130.

In a preferred implementation of the present invention, the said inspection unit 120 may include, but not necessarily, a plurality of sensor array configured to detect at least one of the defective labels or the good labels, a camera unit configured to compare a current label on the label path with a predetermined configurations so as to identify the good labels or the defective labels and an activator unit configured to activate a signal corresponding to the current label wherein, the activator unit activates a good label signal or a defective label signal.

The defective label discarding unit 130, is positioned after the inspection unit 120, in the label path 110, to discard the defective labels from the label web, the defective label discarding unit further includes a push mechanism, a movable plate and a static guide roller in the label path. In an embodiment, the movable plate is configured inside the static guide roller. In yet another embodiment, the push mechanism is configured either to positioned at an original position in case the push mechanism receives the good label signal so that the movable plate is placed inside the static guide roller or the push mechanism pushes the movable plate if the push mechanism receives the defective label signal from the inspection unit 120, so that the movable plate comes out of the static guide roller to give an angular motion to the label path 110 so as to give a mechanical pressure to initial portion of the defective label on the label path 110 in contact with the movable plate that results in peeling of the initial portion of the defective label.

In another preferred embodiment, the movable plate is configured inside the static guide roller so as to achieve a smooth static guide roller outer surface.

In yet another embodiment, the signal can be generated either for each label of the plurality of label in the label path or only for the defective label in the plurality of labels in the label web, further wherein, the signal is generated with a unique identity of label. In further embodiment, the movable plate triggers to original positing after receiving the good label signal and triggers out of the static guide roller after receiving the bad label signal. In case of consecutive similar signal, the movable plate remains on the same position till different signal is received.

A collecting unit 140, is chosen so as to collect the plurality of defective labels, the collecting unit 140, includes a motorized roll winder to move in case of the defective label signal. In a preferred embodiment, the motorized roll winder is positioned such that the initial portion of the defective label sticks in a roll of the motorized roll winder once it comes out of the label path so that full label is plucked out of the label path and sticks in the motorized roll winder. The roll of the motorized roll winder can be of paper, plastic on any material that can hold the defective label coming out of the defective label discarding unit 130. In a non-limiting example the motorized roll winder can be of a waste release paper of the label web.

In an embodiment, the collecting unit 140, activates with the defective label signal and deactivates with the good label signal.

A labeling unit 150, is placed at the destination station to label the good label in a required product. Hence, at a position of the defective label in the label path 110, that has been discarded by the defective label discarding unit 130, the labeling unit 150, does not apply label on the required product as the position of the defective label is vacant. Hence the required product remains unlabeled that can be re-utilized for labeling.

A processor 160, is used to synchronize the label path 110, the inspection unit 120, the defective label discarding unit 130, the collecting unit 140 and the labeling unit 150.

In a preferred embodiment, the label path 110, the inspection unit 120, the defective label discarding unit 130, the collecting unit 140 and the labeling unit 150 can be either at single station of the labeling machine or at various stations of the labeling machine.

Figure 2:
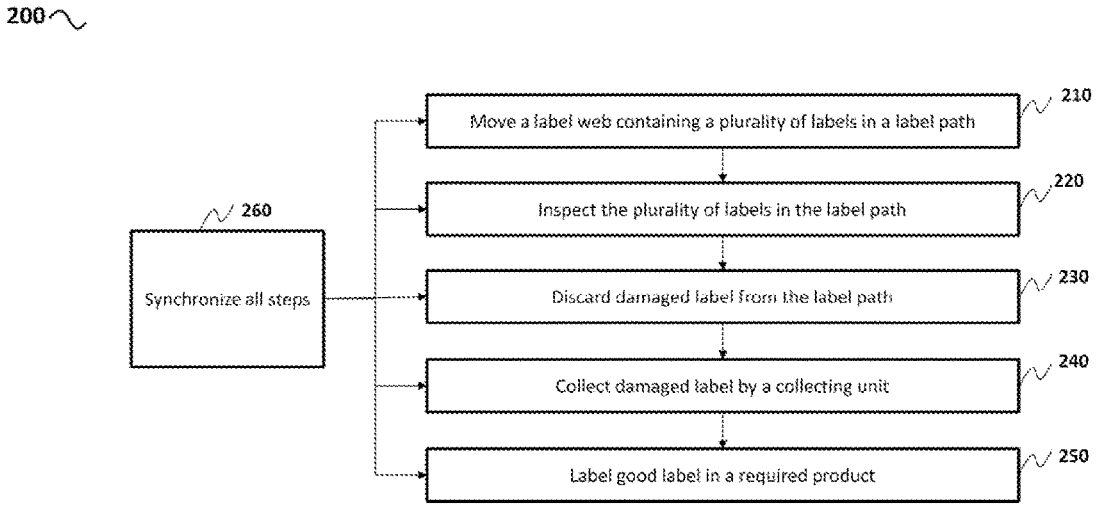
FIG. 2 illustrates a process to discard defective label from a labeling machine, in accordance with an exemplary embodiment of the present invention.

FIG. 2 illustrates a process to discard defective label from a labeling machine, in accordance with an exemplary embodiment of the present invention.

Referring to FIG. 2, a process 200, illustrates the process to discard defective label from a labeling machine.

In accordance with an aspect of the present invention, a process 200 is provided to discard defective label from a labeling machine.

A label web containing a plurality of labels in a label path is moved from an origin station to a destination station in a labeling machine at STEP 210. The said label path includes a label path to carry the plurality of labels from the origin station to the destination station. In an embodiment, the plurality of labels includes a plurality of good labels and a plurality of bad labels.

In a preferred embodiment, defective labels are those labels those do not match a predetermined parameters of good label, for a non-limiting example, a label with different color or missing a part or whole of a text, or a logo, or a vision, or a coding by various coding techniques or a barcode information is the defective label.

At STEP 220, the plurality of labels in the label path is inspected by an inspection unit to detect the defective labels from the plurality of labels in the label path. The said inspection unit 120, further includes a defect detector unit configured to compare a current label on the label web with a pre-required configuration so as to identify the plurality of good labels or the plurality of defective labels. In an embodiment, the said inspection unit 120 sends a good label signal or a defective label signal to a defective label discarding unit 130.

In a preferred non-limiting implementation of the invention, the inspection of the plurality of labels may include, not limited to, steps of detecting at least one of the defective labels or the good labels by a sensor array, comparing a current label on the label path with a predetermined configurations by a camera unit so as to identify the good labels or the defective labels and activating a signal corresponding to the current label by an activator unit. In an embodiment the said signal includes at least one of a good label signal or a defective label signal.

In yet another embodiment, the signal can be generated either for each label of the plurality of label in the label web or only for the defective label in the plurality of labels in the label web, further wherein, the signal is generated with a unique identity of label. In further embodiment, the movable plate triggers to original positing after receiving the good label signal and triggers out of the static guide roller after receiving the bad label signal. In case of consecutive similar signal, the movable plate remains on the same position till different signal is received.

The defective label from the label web is discarded at STEP 230, by a defective label discarding unit. In an embodiment discarding the defective label includes steps of pushing a movable plate placed in a static guide roller by a push mechanism out of the static guide roller after receiving the defective label signal. In a preferred embodiment, the push mechanism is configured either to positioned at an original position in case the push mechanism receives the good label signal so that the movable plate is placed inside the static guide roller or the push mechanism pushes the movable plate if the push mechanism receives the defective label signal from the inspection unit so that the movable plate comes out of the static guide roller to give an angular motion to the label path so as to give a mechanical pressure to an initial portion of the defective label on the label path in contact with the movable plate that results in peeling of the initial portion of the defective label.

In another preferred embodiment, the movable plate is configured inside the static guide roller so as to achieve a smooth static guide roller outer surface. In further embodiment, the movable plate triggers to original positing after receiving the good label signal and triggers out of the static guide roller after receiving the bad label signal. In case of consecutive similar signal, the movable plate remains on the same position till different signal is received.

At STEP 240, a collector unit collects the plurality of defective labels when the defective label signal is received. In an embodiment, the plurality of defective label is collected by placing a motorized roll winder such that the initial portion of the defective label peeled out by the moving plate at STEP 230, sticks to a roll in the motorized roll winder so as to pluck full said defective label and stick in the motorized roll winder of the collector unit. The roll in the motorized roll winder can be of paper, plastic on any material that can hold the defective label coming out of the defective label discarding unit 130. In a non-limiting example the motorized roll winder can be of a waste release paper of the label web.

In an embodiment, the collecting unit at STEP 240, activates with the defective label signal and deactivates with the good label signal.

The good label is labeled in the destination station to a required product at STEP 250, after receiving a good label signal. Since bad label is collected by the collector unit at STEP 240, the label path has no label at that space and hence the required product is not labeled for the bad label signal.

STEP 260, synchronizes the steps of moving the label web at STEP 210, inspecting the plurality of labels at STEP 220, discarding the defective label from the label path at STEP 230, collecting the plurality of defective labels by the collecting unit at STEP 240 and the labeling of the good label in the required product by a processor at STEP 250.

In a preferred embodiment, the label path at STEP 210, the inspection unit at STEP 220, the defective label discarding unit at STEP 230, the collecting unit at STEP 240 and the labeling unit at STEP 250 can be either at single station of the labeling machine or at various stations of the labeling machine.

Figure 3:
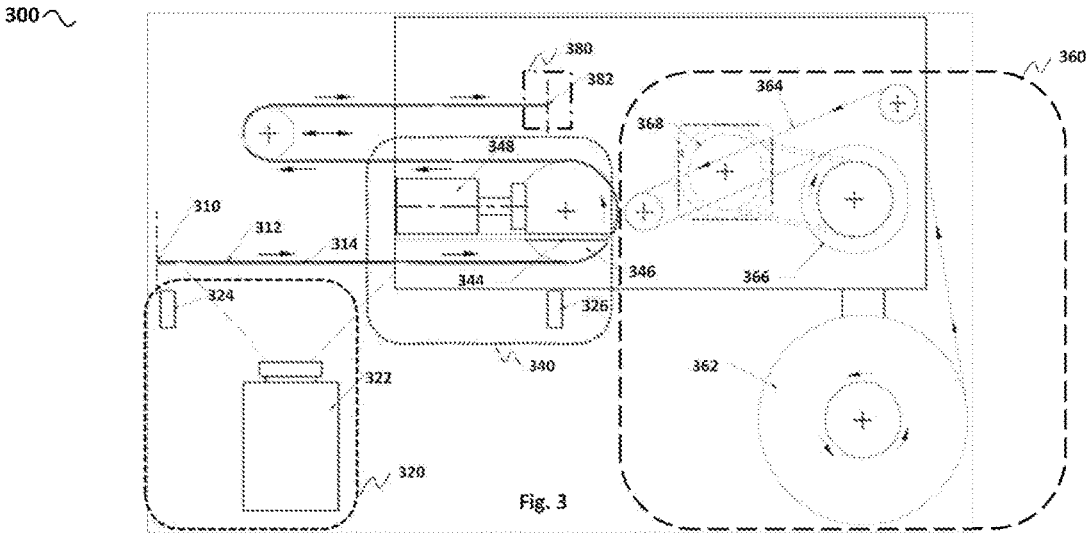
FIG. 3 illustrates an apparatus to discard defective label from a labeling machine, in accordance with an exemplary implementation of the present invention.

FIG. 3 illustrates an apparatus to discard defective label from a labeling machine, in accordance with an exemplary implementation of the present invention.

Referring to FIG. 3, an arrangement 300, illustrates an apparatus to discard defective label from a labeling machine.

In accordance with an aspect of the present invention, an arrangement 300 is provided for an apparatus to discard defective label from a labeling machine. A label path 312, is selected to move a label web including a plurality of labels 314 from an origin station 310 to a destination station 382. The said label path 312 further includes a label path (shown as arrow) to carry the plurality of labels 314 from the origin station 310 to the destination station 382. In an embodiment the plurality of labels 314 includes a plurality of good labels or a plurality of defective labels or a combination thereof. In a preferred embodiment, defective labels are those labels those do not match a pre-determined parameters of good label, for a non-limiting example, a label with different color or miss a part or whole of a text, or a logo, or a vision, or a coding by various coding techniques or a barcode information is the defective label.

An inspection unit 320, is placed in the label path 312, to detect the defective labels from the plurality of labels 314 in the label path (shown as arrow), the said inspection unit 320, further includes a defect detector unit configured to compare a current label on the label web with a pre-required configurations so as to identify the plurality of good labels or the plurality of defective labels. In an embodiment, the said inspection unit 320 sends a good label signal or a defective label signal to a defective label discarding unit 340.

In a non-limiting implantation, the said inspection unit 320 may include, a plurality of sensor array 324 configured to detect at least one of the defective labels or the good labels, a camera unit 322 configured to compare a current label on the label path (shown as arrow) with a predetermined configurations so as to identify the good labels or the defective labels and an activator unit 326 configured to activate a signal corresponding to the current label. In a preferred embodiment, the activator unit 326 activates a good label signal or a defective label signal.

The defective label discarding unit 340, is positioned after the inspection unit 320, in the label path 312, to discard the defective labels from the label web (shown as arrow), the defective label discarding unit further includes a push mechanism 348, a movable plate 344 and a static guide roller 346 in the label path 312. In yet another embodiment, the movable plate 344 is configured inside the static guide roller 346, wherein, the push mechanism 348 is configured either to positioned at an original position in case the push mechanism 348 receives the good label signal so that the movable plate 344 is placed inside the static guide roller 346 or the push mechanism 348 pushes the movable plate 344 if the push mechanism 348 receives the defective label signal from the inspection unit 320, so that the movable plate 344 comes out of the static guide roller 346 to give an angular motion to the label path (shown as arrow) so as to give a mechanical pressure to the starting of the defective label on the label path (shown as arrow) in contact with the movable plate 344 that results in peeling of an initial portion of the defective label. In an embodiment the push mechanism 348 can be for a non-limiting example, a pneumatic cylinder.

In another preferred embodiment, the movable plate 344 is configured inside the static guide roller 346 so as to achieve a smooth static guide roller outer surface.

In yet another embodiment, the signal can be generated either for each label of the plurality of label 314 in the label path (shown as arrow) or only for the defective label in the plurality of labels 314 in the label path (shown as arrow), further wherein, the signal is generated with a unique identity of label.

A collecting unit 360, is chosen so as to collect the plurality of defective labels, the collecting unit 360, includes a motorized roll winder containing a roll 364 to move in case of the defective label signal. In a preferred embodiment, the roll 364 of the motorized roll winder is positioned such that the initial portion of the defective label sticks in the motorized roll winder once it comes out of the label path (shown as arrow) so that full label is plucked out of the label path (shown as arrow) and sticks in the roll 364 of the motorized roll winder. The motorized roll winder can be of paper, plastic on any material that can hold the defective label coming out of the defective label discarding unit 340. In a non-limiting example the motorized roll winder can be of a waste release paper of the label web.

In an embodiment, the collecting unit 360, activates with the defective label signal and deactivates with the good label signal.

In an exemplary implementation of the present invention, the collecting unit 360, includes a motorized roll un-winder 362. The motorized roll un-winder 362 includes a roll of substrate. The substrate can be any substrate that has capability to stick labels onto it, for a non-limiting example, a paper roll. The roll 364 of the motorized roll winder 366, moves through a very close proximity when the movable plate 344, is out of the static guide roller 346 so as to stick the defective label coming out due to mechanical pressure created on the label path (shown as arrow) by the movable plate 344. Once the initial of the defective label sticks on the roll 364 of the motorized roll winder 366, a driver pulley 368 rotates a motorized roll winder 366 so as to pluck full defective label from the label path (shown as arrow). In an embodiment, the driver pulley 368 starts after receiving the defective label signal.

A labeling unit 380, is placed at the destination station 382 to label the good label in a required product. Hence, at a position of the defective label in the label path 312, that has been discarded by the defective label discarding unit 340, the labeling unit 380, does not apply label on the required product as the position of the defective label is vacant so as to get the required product without label.

A processor (not shown), is used to synchronize the label path 312, the inspection unit 320, the defective label discarding unit 340, the collecting unit 360 and the labeling unit 380.

In a preferred embodiment, the label path 312, the inspection unit 320, the defective label discarding unit 340, the collecting unit 360 and the labeling unit 380 can be either at single station of the labeling machine or at various stations of the labeling machine.

Figure 4:
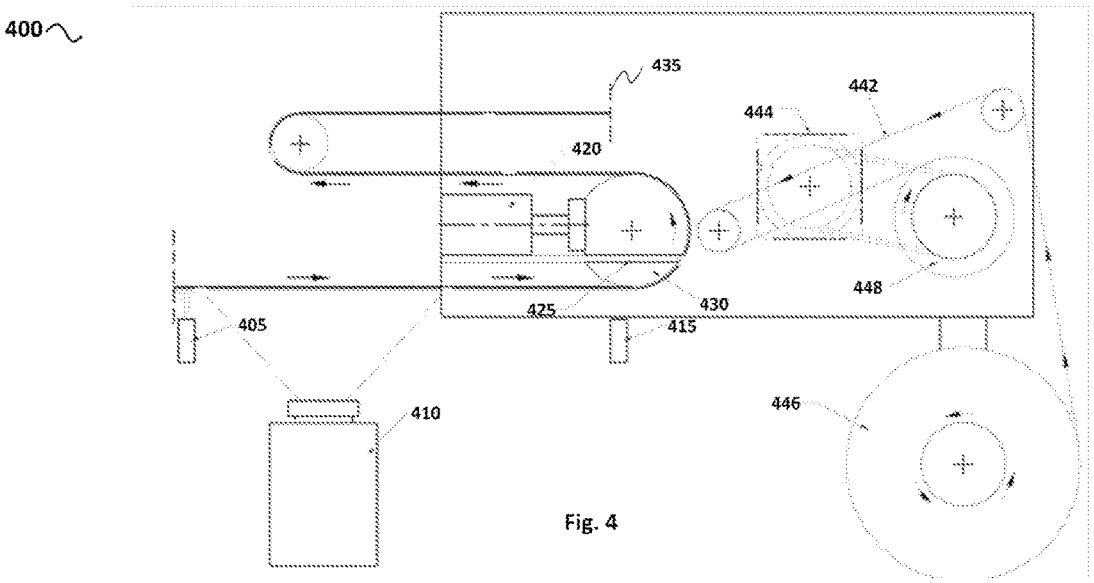
FIG. 4 illustrates an apparatus to discard defective label from a labeling machine, in accordance with an exemplary implementation of the present invention, wherein, a sensor detects label in the label path.

FIG. 4 illustrates an apparatus to discard defective label from a labeling machine, in accordance with an exemplary implementation of the present invention, wherein, a sensor 405 detects label in a label path (shown as arrow).

Referring to FIG. 4, an arrangement 400, illustrates an apparatus, for a non-limiting example of the present invention, to discard defective label from a labeling machine, wherein, the sensor 405 detects label in the label path (shown as arrow).

In an exemplary implementation of the present invention, the FIG. 4, illustrates an arrangement when the sensor 405, detects a label in the label path (shown as arrow). The sensor 405, sends a signal to camera unit 410 informing a new label in the label path (shown as arrow). The camera unit 410 captures image of the new label in the label path (shown as arrow) and compares with a predetermined configurations so as to identify a good label or a defective label. In a preferred embodiment, defective labels are those labels those do not match a predetermined parameters of good label, for a non-limiting example, a label with different color or missing a part or whole of a text, or a logo, or a vision, or a coding by various coding techniques or a barcode information is the defective label.

The camera unit 410, sends signal corresponding to either of the good label or the bad label to an activator unit 415. The activator unit 415, after receiving the signal from the camera unit 410, determines to send signal to a push mechanism 420. In a preferred embodiment, the activator unit 415, sends signal to a push mechanism in case of a defective label.

In case of good label the activator unit 415, informs the push mechanism 420 to keep a movable plate 425 inside a static guide roller 430. The good label goes directly to a destination station 435, wherein, the good label is applied in a required product.

In another preferred embodiment, the movable plate 425 is configured inside the static guide roller 430 so as to achieve a smooth static guide roller outer surface.

In yet another embodiment, the signal can be generated either for each label of the plurality of label in the label path (shown as arrow) or only for the defective label in the plurality of labels in the label path (shown as arrow), further wherein, the signal is generated with a unique identity of label.

In case of good label a collector unit is at idle stage, wherein a roll 442, a driver pulley 444, a motorized roll un-winder 446 and a motorized roll winder 448 can be either at moving stage or at idle stage.

In an embodiment, the collecting unit, activates with the defective label signal and deactivates with the good label signal.

Figure 5:
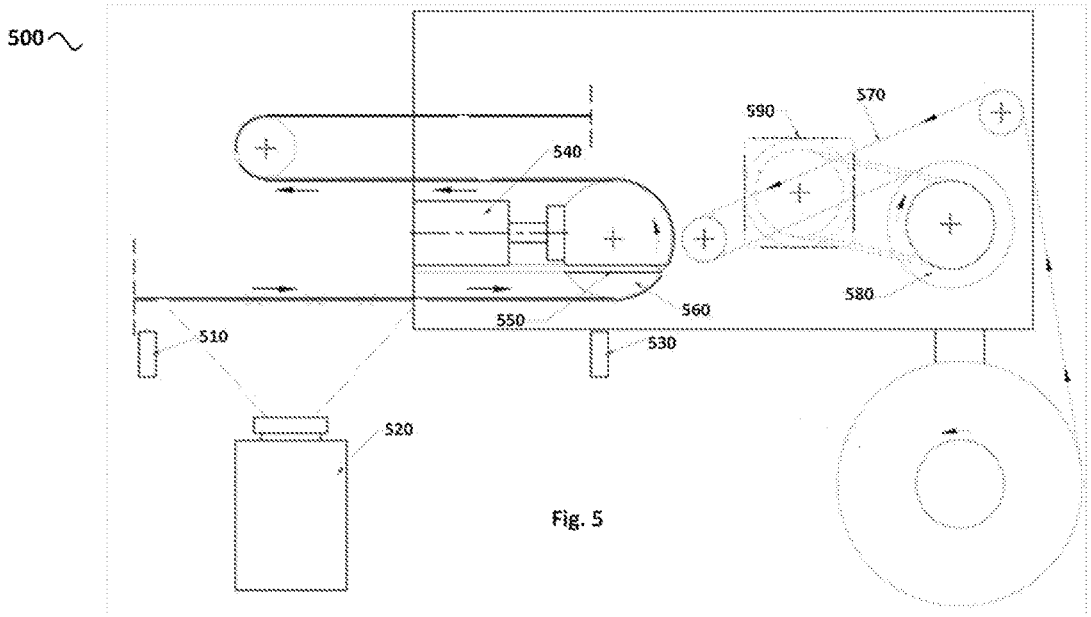
FIG. 5 illustrates an apparatus to discard defective label from a labeling machine, in accordance with an exemplary implementation of the present invention, wherein, an inspection unit detects a defective label.

FIG. 5 illustrates an apparatus to discard defective label from a labeling machine, in accordance with an exemplary implementation of the present invention, wherein, an inspection unit detects a defective label.

Referring to FIG. 5, an arrangement 500, illustrates, for a non-limiting example of the present invention, an apparatus to discard defective label from a labeling machine, wherein, the inspection unit detects the defective label.

In an exemplary implementation of the present invention, the FIG. 5 illustrates the arrangement 500 wherein the label path (as shown by arrow) carries a defective label (as shown by cross) with good labels.

The sensor 510, sends a signal to camera unit 520 informing a new label in the label path (shown as arrow). The camera unit 520 captures image of the new label in the label path (shown as arrow) and compares with a predetermined configurations so as to identify a good label or a defective label. In a preferred embodiment, defective labels are those labels those do not match a predetermined parameters of good label, for a non-limiting example, a label with different color or missing a part or whole of a text, or a logo, or a vision, or a coding by various coding techniques or a barcode information is the defective label.

The present figure FIG. 5 illustrates a case when the camera unit 520 detects the defective label. The camera unit 520 sends a defective label signal to an activator unit 530. The activator unit 530 activates a push mechanism 540, wherein, the push mechanism 540 pushes a movable plate 550 out of the static guide roller 560 so as to create an angular motion to the label path (shown as arrow) at point of contact of the label path (shown as arrow) and the static guide roller 560. The activator unit 530 also sends a unique id for which the push mechanism 540 has to react. At the time when the defective label with the unique id comes to contact with the static guide roller 560, the push mechanism 540 pushes the movable plate 550 out of the static guide roller 560. Once the movable plate 550 comes out of the static guide roller 560, it creates an angular motion to the label path (shown as arrow) and hence creates a mechanical pressure to the defective label so as initial portion of the defective label comes out due to said mechanical pressure. The defective label then sticks to a roll 570 of the motorized roll winder 580 of a collector unit which is controlled by a driver pulley 590. In an embodiment, the driver pulley 590, activates with the defective label signal and deactivates with the good label signal.

The label path (shown as arrow) then has a vacant space wherein at a destination station a required product is not labeled due to lack of label.

In yet another embodiment, the signal can be generated either for each label of the plurality of label in the label path (shown as arrow) or only for the defective label in the plurality of labels in the label path (shown as arrow), further wherein, the signal is generated with a unique identity of label.

Figure 6:
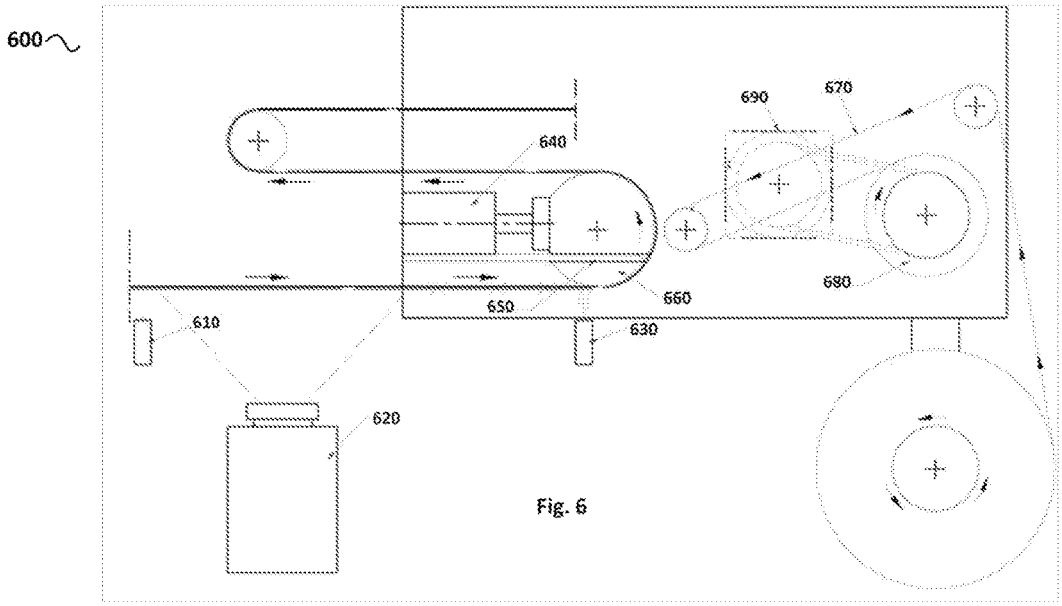
FIG. 6 illustrates an apparatus to discard defective label from a labeling machine, in accordance with an exemplary implementation of the present invention, wherein, the inspection camera sends defective label signal to a defective label discarding unit.

FIG. 6 illustrates, for a non-limiting example of the present invention, an apparatus to discard defective label from a labeling machine, in accordance with an exemplary implementation of the present invention, wherein, an activator unit sends defective label signal to a push mechanism in a defective label discarding unit.

Referring to FIG. 6, an arrangement 600, illustrates an apparatus to discard defective label from a labeling machine, wherein, the activator unit sends defective label signal to the push mechanism in the defective label discarding unit.

In an exemplary implementation of the present invention, the FIG. 6 illustrates the arrangement 600 wherein the label path (as shown by arrow) carries a defective label (as shown by cross) with good labels.

The sensor 610, sends a signal to camera unit 620 informing a new label in the label path (shown as arrow). The camera unit 620 captures image of the new label in the label path (shown as arrow) and compares with a predetermined configurations so as to identify a good label or a defective label. In a preferred embodiment, defective labels are those labels those do not match a predetermined parameters of good label, for a non-limiting example, a label with different color or missing a part or whole of a text, or a logo, or a vision, or a coding by various coding techniques or a barcode information is the defective label.

The camera unit 620 sends a defective label signal to an activator unit 630. The present figure FIG. 6 illustrates a case when the camera unit 620 detects the defective label and the defective label reaches to a point in the label path (shown as arrow) wherein the activator unit 630 sends the defective label signal to the push mechanism 640 for further action. The activator unit 630 activates a push mechanism 640, wherein, the push mechanism 640 pushes a movable plate 650 out of the static guide roller 660 so as to create an angular motion to the label path (shown as arrow) at point of contact of the label path (shown as arrow) and the static guide roller 660. At the time when the defective label with the unique id comes to contact with the static guide roller 660, the push mechanism 640 will push the movable plate 650 out of the static guide roller 660. Once the movable plate 650 comes out of the static guide roller 660, it creates an angular motion to the label path (shown as arrow) and hence creates a mechanical pressure to the defective label so as initial portion of the defective label comes out due to said mechanical pressure. The defective label then sticks to a roll 670 of a motorized roll winder 680 of a collector unit which is controlled by a driver pulley 690. In an embodiment, the driver pulley 690, activates with the defective label signal and deactivates with the good label signal.

The label path (shown as arrow) then has a vacant space wherein at a destination station a required product is not labeled due to lack of label.

In yet another embodiment, the signal can be generated either for each label of the plurality of label in the label path (shown as arrow) or only for the defective label in the plurality of labels in the label path (shown as arrow), further wherein, the signal is generated with a unique identity of label.

Figure 7:
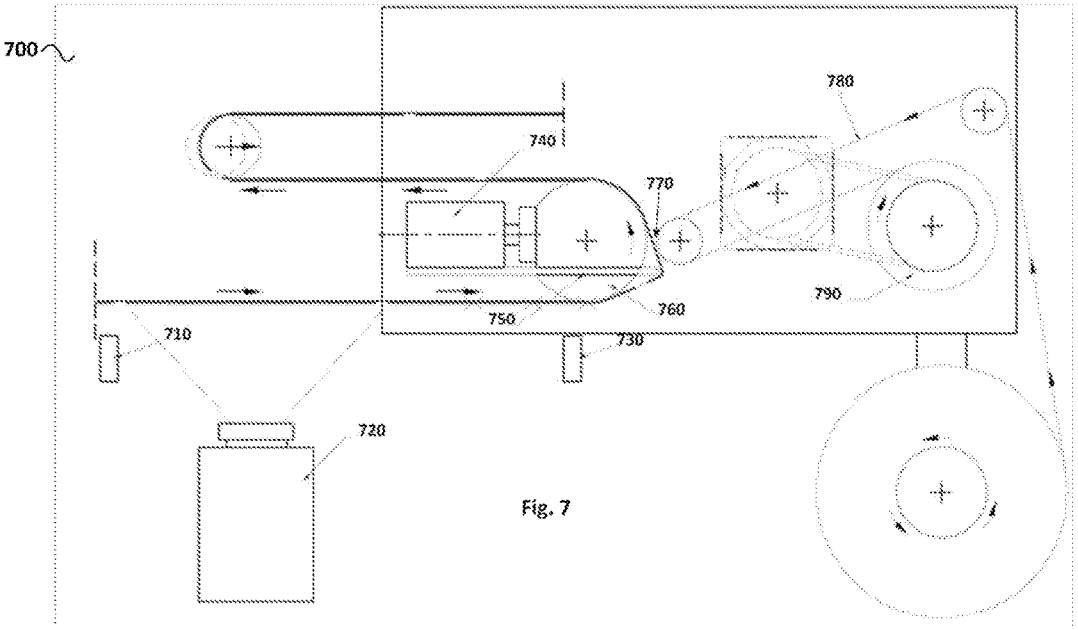
FIG. 7 illustrates an apparatus to discard defective label from a labeling machine, in accordance with an exemplary implementation of the present invention wherein, a movable plate in the defective label discarding unit is triggered by a defective label signal.

FIG. 7 illustrates, for a non-limiting example of the present invention, an apparatus to discard defective label from a labeling machine, in accordance with an exemplary implementation of the present invention wherein, a movable plate in the defective label discarding unit is triggered by a defective label signal.

Referring to FIG. 7, an arrangement 700, illustrates an example for an apparatus to discard defective label from a labeling machine, wherein, the movable plate in the defective label discarding unit is triggered by a defective label signal.

In an exemplary implementation of the present invention, the FIG. 7 illustrates the arrangement 700 wherein the movable plate in the defective label discarding unit is triggered by a defective label signal.

The sensor 710, sends a signal to camera unit 720 informing a new label in the label path (shown as arrow). The camera unit 720 captures image of the new label in the label path (shown as arrow) and compares with a predetermined configurations so as to identify a good label or a defective label. In a preferred embodiment, defective labels are those labels those do not match a predetermined parameters of good label, for a non-limiting example, a label with different color or missing a part or whole of a text, or a logo, or a vision, or a coding by various coding techniques or a barcode information is the defective label.

The camera unit 720 sends a defective label signal to an activator unit 730. The activator unit 730 activates a push mechanism 740, wherein, the push mechanism 740 pushes a movable plate 750 out of the static guide roller 760 so as to create an angular motion to the label path (shown as arrow) at point of contact of the label path (shown as arrow) and the static guide roller 760. The activator unit 730 also sends a unique id for which the push mechanism 740 has to react. At the time when the defective label with the unique id comes to contact 770 with the static guide roller 760, the push mechanism 740 pushes the movable plate 750 out of the static guide roller 760.

The present figure FIG. 7 illustrates a case when the movable plate is out of the static guide roller. Once the movable plate 750 comes out of the static guide roller 760, it creates an angular motion to the label path (shown as arrow) at 770 and hence creates a mechanical pressure to the defective label at 770 so as initial of the defective label comes out due to said mechanical pressure. The defective label then sticks to a roll 780 of a motorized roll winder 790 of a collector unit which is controlled by a driver pulley. In an embodiment, the driver pulley activates with the defective label signal and deactivates with the good label signal.

The label path (shown as arrow) then has a vacant space wherein at a destination station a required product is not labeled due to lack of label.

In yet another embodiment, the signal can be generated either for each label of the plurality of label in the label path (shown as arrow) or only for the defective label in the plurality of labels in the label path (shown as arrow), further wherein, the signal is generated with a unique identity of label.

Figure 8:
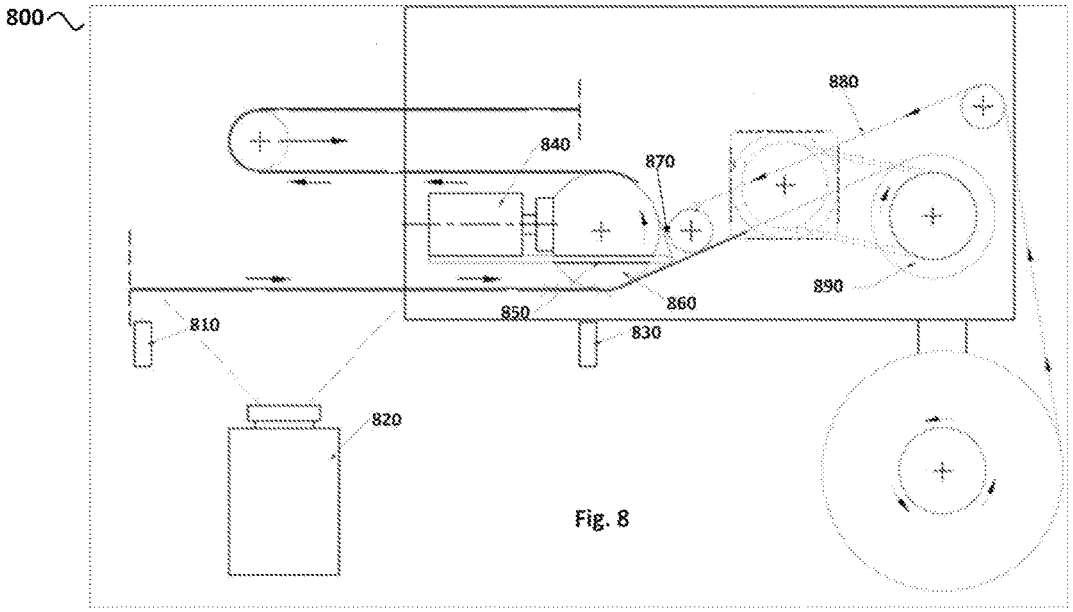
FIG. 8 illustrates an apparatus to discard defective label from a labeling machine, in accordance with an exemplary implementation of the present invention, wherein, the defective label comes out due to mechanical pressure by the movable plate.

FIG. 8 illustrates, for a non-limiting example of the present invention, apparatus to discard defective label from a labeling machine, in accordance with an exemplary implementation of the present invention, wherein, the defective label comes out due to mechanical pressure by the movable plate.

Referring to FIG. 8, an example for an arrangement 800, illustrates an apparatus to discard defective label from a labeling machine, wherein, the defective label comes out due to mechanical pressure by the movable plate.

In an exemplary implementation of the present invention, the FIG. 8 illustrates the arrangement 800 wherein the defective label comes out due to mechanical pressure by the movable plate.

The sensor 810, sends a signal to camera unit 820 informing a new label in the label path (shown as arrow). The camera unit 820 captures image of the new label in the label path (shown as arrow) and compares with a predetermined configurations so as to identify a good label or a defective label. In a preferred embodiment, defective labels are those labels those do not match a predetermined parameters of good label, for a non-limiting example, a label with different color or missing a part or whole of a text, or a logo, or a vision, or a coding by various coding techniques or a barcode information is the defective label.

The camera unit 820 sends a defective label signal to an activator unit 830. The activator unit 830 activates a push mechanism 840, wherein, the push mechanism 840 pushes a movable plate 850 out of the static guide roller 860 so as to create an angular motion to the label path (shown as arrow) at point of contact of the label path (shown as arrow) and the static guide roller 860. The activator unit 830 also sends a unique id for which the push mechanism 840 has to react. At the time when the defective label with the unique id comes to contact 870 with the static guide roller 860, the push mechanism 840 pushes the movable plate 850 out of the static guide roller 860.

Once the movable plate 850 comes out of the static guide roller 860, it creates an angular motion to the label path (shown as arrow) at 870 and hence creates a mechanical pressure to the defective label at 870 so as initial of the defective label comes out due to said mechanical pressure.

The present figure FIG. 8 illustrates a case when the initial of the defective label comes out due to mechanical pressure created by the movable plate 850 at 870. The defective label then sticks to a roll 880 of the motorized roll winder 890 of a collector unit which is controlled by a driver pulley. In an embodiment, the driver pulley activates with the defective label signal and deactivates with the good label signal.

The label path (shown as arrow) then has a vacant space wherein at a destination station a required product is not labeled due to lack of label.

In yet another embodiment, the signal can be generated either for each label of the plurality of label in the label path (shown as arrow) or only for the defective label in the plurality of labels in the label path (shown as arrow), further wherein, the signal is generated with a unique identity of label.

In a preferred embodiment, the activator unit 830, activates rotation of the motorized roll winder 890. Hence once initial of the defective label at 870 sticks to the roll 880, due to a force created by rotation of the motorized roll winder 890, whole defective label is plucked out of the label path (shown as arrow) leaving the space blank.

Figure 9:
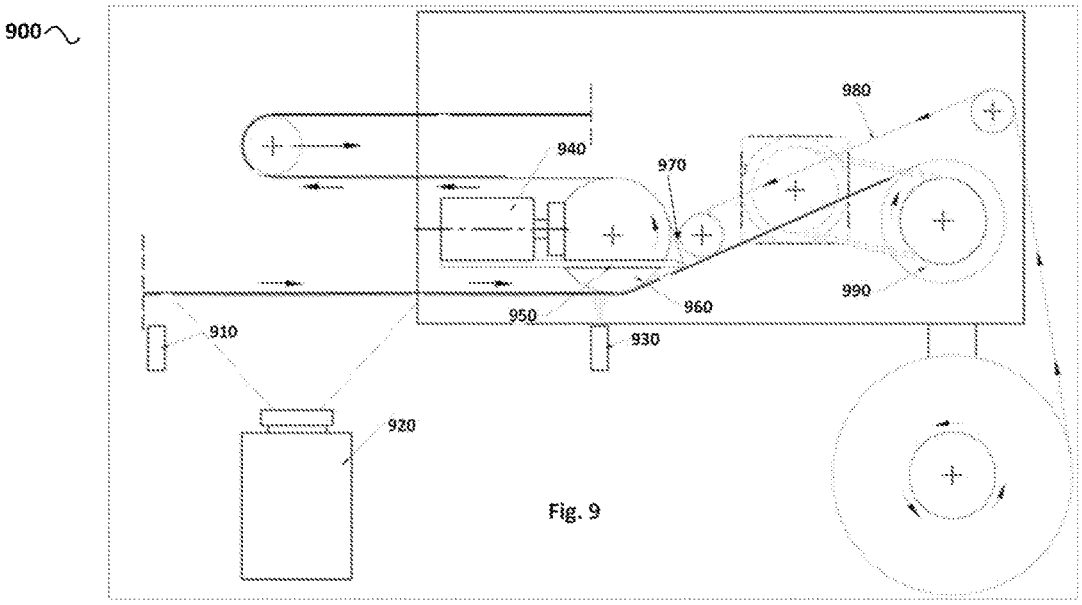
FIG. 9 illustrates an apparatus to discard defective label from a labeling machine, in accordance with an exemplary implementation of the present invention, wherein, the defective label is collected by a collector unit.

FIG. 9 illustrates, for a non-limiting example of the present invention, an apparatus to discard defective label from a labeling machine, in accordance with an exemplary implementation of the present invention, wherein, the defective label is collected by a collector unit.

Referring to FIG. 9, an example for an arrangement 900, illustrates an apparatus to discard defective label from a labeling machine, wherein, the defective label is collected by a collector unit.

In an exemplary implementation of the present invention, the FIG. 9 illustrates the arrangement 900 wherein the defective label is collected by a collector unit.

The sensor 910, sends a signal to camera unit 920 informing a new label in the label path (shown as arrow). The camera unit 920 captures image of the new label in the label path (shown as arrow) and compares with a predetermined configurations so as to identify a good label or a defective label. In a preferred embodiment, defective labels are those labels those do not match a predetermined parameters of good label, for a non-limiting example, a label with different color or missing a part or whole of a text, or a logo, or a vision, or a coding by various coding techniques or a barcode information is the defective label.

The camera unit 920 sends a defective label signal to an activator unit 930. The activator unit 930 activates a push mechanism 940, wherein, the push mechanism 940 pushes a movable plate 950 out of the static guide roller 960 so as to create an angular motion to the label path (shown as arrow) at point of contact of the label path (shown as arrow) and the static guide roller 960. The activator unit 930 also sends a unique id for which the push mechanism 940 has to react. At the time when the defective label with the unique id comes to contact 970 with the static guide roller 960, the push mechanism 940 pushes the movable plate 950 out of the static guide roller 960.

Once the movable plate 950 comes out of the static guide roller 960, it creates an angular motion to the label path (shown as arrow) at 970 and hence creates a mechanical pressure to the defective label at 970 so as initial of the defective label comes out due to said mechanical pressure. The defective label then sticks to a roll 980 of a motorized roll winder 990 of a collector unit which is controlled by a driver pulley. The present figure FIG. 9 illustrates a case when the movable plate is out of the static guide roller.

The label path (shown as arrow) then has a vacant space wherein at a destination station a required product is not labeled due to lack of label.

In yet another embodiment, the signal can be generated either for each label of the plurality of label in the label path (shown as arrow) or only for the defective label in the plurality of labels in the label path (shown as arrow), further wherein, the signal is generated with a unique identity of label.

In a preferred embodiment, the activator unit 930, activates rotation of the motorized roll winder 990. Hence once initial of the defective label at 970 sticks to the roll 980, due to a force created by rotation of the motorized roll winder 990, whole defective label is plucked out of the label path (shown as arrow) leaving the space blank.

Figure 10:
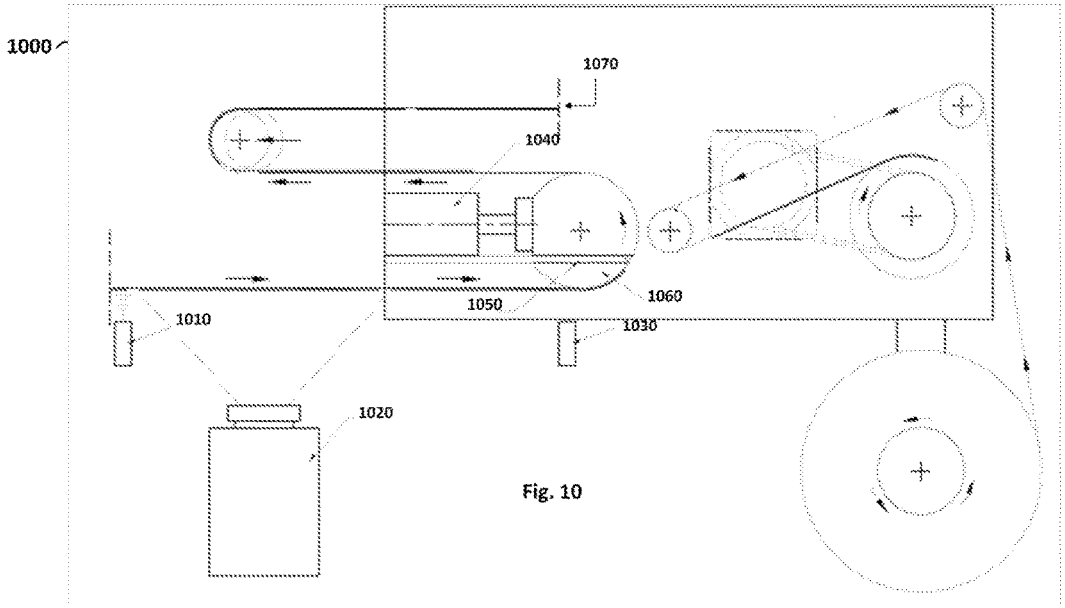
FIG. 10 illustrates an apparatus to discard defective label from a labeling machine, in accordance with an exemplary implementation of the present invention, wherein, the movable plate goes inside a static guide roller in the defective label discarding unit after getting a good label signal.

FIG. 10 illustrates, for a non-limiting example of the present invention, an apparatus to discard defective label from a labeling machine, in accordance with an exemplary implementation of the present invention, wherein, the movable plate goes inside a static guide roller in the defective label discarding unit after getting a good label signal.

Referring to FIG. 10, an example for an arrangement 1000, illustrates an apparatus to discard defective label from a labeling machine, wherein, the movable plate goes inside a static guide roller in the defective label discarding unit after getting a good label signal.

In an exemplary implementation of the present invention, the FIG. 10 illustrates the arrangement 1000 wherein the movable plate goes inside a static guide roller in the defective label discarding unit after getting a good label signal.

The sensor 1010, sends a signal to camera unit 1020 informing a new label in the label path (shown as arrow). The camera unit 1020 captures image of the new label in the label path (shown as arrow) and compares with a predetermined configurations so as to identify a good label or a defective label. In a preferred embodiment, defective labels are those labels those do not match a predetermined parameters of good label, for a non-limiting example, a label with different color or missing a part or whole of a text, or a logo, or a vision, or a coding by various coding techniques or a barcode information is the defective label.

The camera unit 1020 sends a good label signal to an activator unit 1030. The activator unit 1030 sends a good label signal to a push mechanism 1040, wherein, the push mechanism 1040 informs a movable plate 1050 to stay in the static guide roller 1060 so as to create a smooth movement of the label path (shown as arrow).

The present figure FIG. 10 illustrates a case when the movable plate is inside the roller 1060. The label path (shown as arrow) carries a plurality of labels to destination station 1070 where labeling of product is done.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An apparatus to discard defective label from a labeling machine, comprises:

a label path configured to move a label web containing a plurality of labels from an origin station to a destination station, wherein, the plurality of labels includes either a plurality of good labels, or a plurality of defective labels, or a combination thereof;

an inspection unit configured to detect the defective labels from the plurality of labels in the label web, the said inspection unit further comprises a defect detector unit configured to compare a current label on the label web with a pre-required configurations so as to identify the plurality of good labels or the plurality of defective labels wherein the said inspection unit sends a good label signal or a defective label signal to a defective label discarding unit;

the defective label discarding unit configured to discard the defective labels from the label web, the defective label discarding unit further comprises a push mechanism, a movable plate and a static guide roller in the label path, wherein, the movable plate is configured inside the static guide roller, further wherein the push mechanism is configured either to positioned at an original position in case the push mechanism receives the good label signal so that the movable plate is placed inside the static guide roller or the push mechanism pushes the movable plate if the push mechanism receives the defective label signal from the inspection unit so that the movable plate comes out of the static guide roller to give an angular motion to the label path so as to give a mechanical pressure to an initial portion of the defective label on the label path in contact with the movable plate that results in peeling of the initial portion of the defective label;

a collecting unit configured to collect the plurality of defective labels, the collecting unit further comprises a motorized roll winder configured to move in case of the defective label signal wherein, the motorized roll winder is positioned such that the initial portion of the defective label sticks in a roll of the motorized roll winder once it comes out of the label path so that full label is plucked out of the label path and sticks in the motorized roll winder, further wherein the roll material is selected on the basis of sticking properties of self-adhesive labels in the label web;

a labeling unit configured to label the good label in a required product; and a processor to synchronize the label path, the inspection unit, the defective label discarding unit, the collecting unit and the labeling unit.

2. The apparatus as claimed in claim 1, wherein the movable plate is configured inside the static guide roller so as to achieve a smooth static guide roller outer surface of the label web moving from origin station to the said labeling unit.

3. The apparatus as claimed in claim 1, wherein the collecting unit activates with the defective label signal and deactivates with the good label signal.

4. The apparatus as claimed in claim 1, wherein the label path, the inspection unit, the defective label discarding unit, the collecting unit and the labeling unit can be either at single station of the labeling machine or at various stations of the labeling machine.

5. The apparatus as claimed in claim 1, wherein the movable plate goes inside the static guide roller once the good label signal is received.

6. A process to discard defective label from a labeling machine, the process comprising:

moving a label web containing a plurality of labels in a label path configured to move from an origin station to a destination station in a labeling machine, wherein, the plurality of labels includes either a plurality of good labels or a plurality of defective labels, or a combination thereof;

inspecting the plurality of labels in the label web in the label path to detect the defective labels from the plurality of labels in the label web, the said inspecting the plurality of labels further comprises steps of detecting at least one of the defective labels or the good labels by a defect detector unit by comparing a current label on the label web with a pre-required configurations so as to identify the plurality of good labels or the plurality of defective labels, wherein the said inspection unit sends at least one of a good label signal or a defective label signal to a defective label discarding unit;

discarding the defective label from the label web, discarding the defective label from the label web further comprises steps of pushing a movable plate placed in a static guide roller by a push mechanism out of the static guide roller after receiving the defective label signal, wherein the push mechanism is configured either to positioned at an original position in case the push mechanism receives the good label signal so that the movable plate is placed inside the static guide roller or the push mechanism pushes the movable plate if the push mechanism receives the defective label signal from the inspection unit so that the movable plate comes out of the static guide roller to give an angular motion to the label path so as to give a mechanical pressure to an initial portion of the defective label on the label path in contact with the movable plate that results in peeling of the initial portion of the defective label;

collecting the plurality of defective labels by a collecting unit when the defective label signal is received, collecting the plurality of defective labels by a collecting unit further comprises steps of placing a motorized roll winder such that initial portion of the defective label peeled out by the moving plate sticks to a roll in the motorized roll winder so as to pluck full said defective label and stick in the roll of the motorized roll winder, further wherein, the roll material is selected on the basis of sticking properties of self-adhesive labels in the label web;

labeling the good label in a required product after receiving the good label signal; and synchronizing the steps of moving the label web, inspecting the plurality of labels, discarding the defective label from the label path, collecting the plurality of defective labels by the collecting unit and the labeling of the good label in the required product by a processor.

7. The process as claimed in claim 6, wherein the movable plate is configured inside the static guide roller so as to achieve a smooth static guide roller outer surface of the label web moving from origin station to the said labeling unit.

8. The process as claimed in claim 6, wherein the collecting unit activates with the defective label signal and deactivates with the good label signal.

9. The process as claimed in claim 6, wherein the label path, the inspection unit, the defective label discarding unit, the collecting unit and the labeling unit can be either at single station of the labeling machine or at various stations of the labeling machine.

10. The process as claimed in claim 6, wherein the movable plate goes inside the static guide roller once the good label signal is received.

* * * * *